US005754092A

United States Patent [19]

Ishida et al.

[11] Patent Number: 5,754,092

[45] Date of Patent: May 19, 1998

[54] RESISTOR TRIMMING METHOD BY THE FORMATION OF SLITS IN A RESISTOR INTERCONNECTING FIRST AND SECOND ELECTRODES

[75] Inventors: Koichi Ishida, Fukui-ken; Masao Yonezawa; Mitsuhiro Hoshii, both of Ishikawa-ken, all of Japan

[73] Assignee: Murata Manufacturing Co., Ltd., Nagaokakyo, Japan

[21] Appl. No.: 629,624

[22] Filed: Apr. 9, 1996

[51] Int. Cl.[6] ..... H01C 10/00

[52] U.S. Cl. ..... 338/195; 338/307

[58] Field of Search ..... 338/195, 307, 338/309, 314

[56] References Cited

U.S. PATENT DOCUMENTS 4,284,970 8/1981 Berrin et al. ..... 338/195

5,043,694 8/1991 Higashi et al. ..... 338/195

5,065,221 11/1991 Imamura ..... 338/195 X 5,198,794 3/1993 Sato et al. ..... 338/195

5,493,148 2/1996 Ohata et al. ..... 338/195 X

*Primary Examiner*—Edward Tso

*Attorney, Agent, or Firm*—Burns, Doane, Swecker & Mathis, LLP

[57] ABSTRACT

A resistor trimming method includes the steps of: forming a first slit from an edge of a resistor interconnecting first and second electrodes provided on an insulating substrate in the proximity of and parallel to the first electrode; forming a second slit as a continuation of the first slit toward to the second electrode perpendicularly to the first slit; forming a third slit from a point of the edge of the resistor and parallel to the first electrode, the point being shifted from the first slit toward the second electrode, the third slit having a greater length than the first slit in a direction along the first electrode; and forming a fourth slit as a continuation of the third slit toward to the second electrodes perpendicularly to the first slit.

21 Claims, 4 Drawing Sheets

RESISTOR TRIMMING METHOD BY THE FORMATION OF SLITS IN A RESISTOR INTERCONNECTING FIRST AND SECOND ELECTRODES

BACKGROUND OF THE INVENTION

1. Field of the Invention

The present invention relates to a resistor trimming method and, more particularly, to a method for trimming a printed resistor formed on an insulating substrate in a hybrid integrated circuit (IC).

2. Description of the Related Art

FIGS. 3 through 8 show plan views of conventional printed resistors having various kinds of slit patterns. In each of these figures, a resistor 1 is formed extending over a pair of electrodes 2*a* and 2*b* provided on an insulating substrate 3 by means of screen printing or the like. Slits 41 through 46 are formed in the resistors 1 by trimming to adjust the resistance value of the resistor 1.

Among the slits 41 through 46 formed by trimming to adjust the resistance, the slit 41 shown in FIG. 3 is formed by trimming so as to extend from one edge of the resistor 1 in parallel with the electrode 2*a* and to be bent perpendicularly approximately in the shape of an L.

The slit 42 shown in FIG. 4 is formed by trimming as a continuation of the slit 41 trimmed approximately in the shape of an L so that the new slit returns toward one edge of the resistor 1 approximately in the shape of a square bottomed J.

The slit 43 shown in FIG. 5 is formed by trimming in the shape of J starting from one edge of the resistor 1. The slit 44 shown in FIG. 6 is formed by scan-cutting off a portion of the resistor 1 from one edge of the resistor 1 between the electrodes 2*a* and 2*b*.

Further, the slit 45 shown in FIG. 7 is formed by trimming in the shape of an U the tops of which extend from one edge of the resistor 1, the width of the U extending from the first electrode 2*a* side to the second electrode 2*b* side.

The slit 46 shown in FIG. 8 is formed by trimming (lean cutting) one end of the resistor 1 linearly between the first electrode 2*a* and the second electrode 2*b* while also cutting parts of the electrodes 2*a* and 2*b*.

The conventional trimming methods described above have had the following problems.

First, resistors having the L-shaped slit 41, the square bottomed J-shaped slit 42 and the J-shaped slit 43 as shown in FIGS. 3 through 5 are susceptible to change of resistance value due to a surge.

More specifically, as shown in FIG. 9A, a current density is distributed non-uniformly in the printed resistor 1 having a L-shaped slit 41, so that a current is concentrated at points D and E which are located near the bending portion and an end portion of the L-shaped slit 41. As a result, microcracks occur at points D and E or the resistor burns at points D and E when the resistor is subjected to a surge. This causes the change of resistance of the resistor. For example, the resistance of these resistors shown in FIGS. 3 through 5 change with 3.350% on average before and after a surge in a lightning surge test.

Second, although the method of forming the slit 44 by scan-cut as shown in FIG. 6 brought about a good surge resistance and it can be said as an effective trimming method, it takes a considerable amount of time for the trimming, thus raising the product's cost.

Third, while the method of forming the slit 45 by trimming approximately in the U-shape as shown in FIG. 7 has the benefit of the trimming being done quickly while maintaining the surge resistance of the scan-cut shown in FIG. 7, there is a possibility that it the resulting structure is a J-shaped slit (similar to one shown in FIG. 5) because the trimming is terminated during the trimming process in the U-shape due to a dispersion of an initial value of the resistor. As a result, there is a possibility that this resistor will suffer from the aforementioned problem.

Fourth, in the method of forming the slit 46 by a lean-cut shown in FIG. 8 (trimming the resistor 1 and the electrodes 2*a* and 2*b*), the trimming is quickly done while maintaining the surge resistance similar to the method of forming the slit 45 by trimming in the U-shape. However, it has been very difficult to program the necessary trimming machinery to completely cut both electrodes 2*a* and 2*b*. The resistor and occasionally the electrodes have not been completely cut, resulting in a parallel electrical connection of the resistor and thus the method lacks reliability.

SUMMARY OF THE INVENTION

It is an object of the present invention to solve the aforementioned problems by providing a resistor trimming method which brings about a good surge resistance and which allows a slit to be formed in the resistor quickly and reliably. It is another object of the present invention to provide a resistor having a slit formed by the resistor trimming method of the present invention.

In order to achieve the aforementioned objects, according to one aspect of the present invention, a resistor trimming method includes the steps of: forming a first slit from an edge of a resistor interconnecting a first and second electrodes provided on an insulating substrate in the proximity of and parallel to the first electrode; forming a second slit as a continuation of the first slit toward the second electrode and perpendicular to the first slit; forming a third slit from a point of the edge of the resistor and parallel to the first electrodes, the point being shifted from the first slit toward the second electrode, the third slit having a greater length than the first slit in a direction parallel to the first electrode; and forming a fourth slit as a continuation of the third slit toward the second electrode and perpendicular to the third slit.

According to another aspect of the present invention, a resistor trimming method includes the step of forming a first slit and second slit as explained above. The method further includes the steps of forming a third slit from the edge of the resistor in the proximity of and parallel to the second electrode, the third slit having a greater length than the first slit in a direction along the first electrode; forming a fourth slit as a continuation of the third slit toward the first electrode and perpendicular to the third slit; forming a fifth slit from a first point of the edge of the resistor and parallel to the first electrode, the point being shifted from the first slit toward the second electrode, the fifth slit having a greater length than the third slit in a direction parallel to the first electrode; and forming a sixth slit as a continuation of the fifth slit toward the first electrode and perpendicular to the fifth slit.

In the novel method of trimming a resistor, the trimming is started from a position very close to one electrode. The average resistance variation rate measured before and after a lightening surge test was as low as 0.003%. Hence, the surge resistance characteristics were good. The resistor can be trimmed quickly and certainly.

Other objects and features of the invention will appear in the course of the description thereof, which follows.

DETAILED DESCRIPTION OF PREFERRED EMBODIMENTS

Example 1

A resistor and a resistor trimming method according to one preferred embodiment of the present invention will be explained with reference to FIG. 1.

Figure 1:
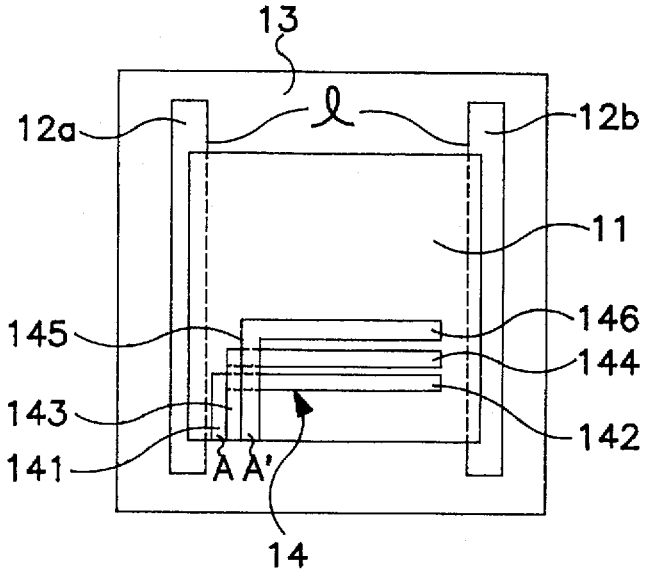
FIG. 1 is a plan view of a trimmed resistor, illustrating one embodiment of the present invention.

As shown in FIG. 1, a resistor (printed resistor) is formed so as to extend between and at least partially over a pair of electrodes 12*a* and 12*b* provided facing to an insulating substrate 13 by means of screen printing of the like. The resistor 11 can be incorporated in a hybrid integrated circuit (IC) or manufactured as a discrete component.

A combined slit 14 is provided in the resistor 11. The combined slit 14 includes a plurality of L-shaped slits each of which consists of a vertical slit and a horizontal slit. More specifically, the combined slit 14 shown in FIG. 1 includes a first L-shaped slit consisting of a first, vertical slit 141 and a second, horizontal slit 142, a second L-shaped slit consisting of a third, vertical slit 143 and a fourth, horizontal slit 144, and a third L-shaped slit consisting of a fifth, vertical slit 145 and a fifth, horizontal slit 146. The vertical slits 141, 143, and 145 are substantially parallel to the first and second electrodes 12*a* and 12*b*, and the horizontal slits 142, 144, and 146 are substantially perpendicular to the first and second electrodes 12*a* and 12*b*.

The first, vertical slit 141 of the first L-shaped slit is formed in the resistor 11 near the first electrode 12*a* and extends from one side toward the opposite side of the resistor 11. It is preferable that the start point A of the first, vertical slit 141 be as close to the first electrode 12*a* as possible, and it is more preferable that the start point A is within about 0.3 mm from the first electrode 12*a*. The second, horizontal slit 142 extends from the end of the first, vertical slit 141 toward the second electrode 12*b*.

A second L-shaped slit is formed in the resistor 11 in the same manner as the first L-shaped slit, but its start point A' of the third, vertical slit 143 is shifted toward the second electrode 12*b*, i.e., it is located at a position nearer to the second electrode 12*b* than the start point A of the first slit. As shown in FIG. 1, it is preferable that the first and third, vertical slits 141 and 143 are closely adjacent to each other so as to form in combination one large vertical slit where the first and third, vertical slits 141 and 143 abut one another. The third, vertical slit 143 is set to be longer than the first vertical slit 141. As a result, a fourth, horizontal slit 144 is formed in the resistor 11 more towards the center of the resistor 11 than the second, horizontal slit 142. The second and fourth, horizontal slits 142 and 144 may be adjacent to each other so as to form an enlarged horizontal slit where they abut one another.

A third L-shaped slit is also formed in the resistor 11 in the same manner as the second L-shaped slit. The start point A" of a third vertical slit 145 is located at a position nearer to the second electrode 12*b* than the start point A' of the second L-shaped slit along the edge of the resistor 11. It is preferable that the vertical slits 141, 143, and 145 are adjacent to each other so as to form a one enlarged vertical slit where they abut. The length of the fifth, vertical slit 145 is greater than the the third, vertical slit 143. The horizontal slits 142, 144, and 146 may be adjacent to each other so as to form an enlarged horizontal slit where they abut.

As a result of the aforementioned configuration of the first, second, and third L-shaped slits, the vertical slits 141, 143, and 145 are formed in the resistor 11 with respective starting positions A, A' and A" shifting from the first electrode 12*a* toward the second electrode 12*b*, while the horizontal slits 142, 144, 146 are formed in the resistor 11 with starting positions shifting from the one side of the resistor 11 toward the opposite side. Each end of the horizontal slits 142, 144, and 146 are preferably located as close to the second electrode 12*b* as possible, and more preferably within 0.3 mm from the second electrode 12*b*.

Although the combined slit 14 shown in FIG. 1 has three L-shaped slits, the number of the L-shaped slit is not limited to three, but may be greate or less in number as determined by the degree the resistance is to be adjusted. Also, the slits formed after the first, vertical slit 141 and the second, horizontal slit 142 can take the form of a continuation of the second, horizontal slit 142 toward to the edge of the resistor and perpendicular to the second, horizontal slit 142. These subsequent slits (i.e., fifth, sixth, etc.) may be in the form of square-bottomed J-shaped or U-shaped slits.

The resistance of the resistor 11 is adjusted by forming the combined slit 14 using a laser beam such as a YAG laser or the like while the resistance value of the resistor 11 is measured. Specifically, the first, vertical slit 141 as a first slit is formed by trimming the resistor 11 from the first start point A close to the first electrode 12*a* and parallel to the first electrode 12*a*. Then, the resistor 11 is continuously trimmed from end of the first, vertical slit 141 toward the second electrode 12*b* perpendicular to the first, vertical slit 141 to form the second, horizontal slit 142 as a second slit.

Subsequently, the resistor 11 is trimmed from the start point A' toward the opposite side of the resistor 11 in parallel to the first electrode 12*a* and then toward to the second electrode 12*b* to form the third, vertical slit 143 and the fourth, horizontal slit 144, respectively, in the same way as the formation of the first vertical slit 141 and the second, horizontal slit 142, respectively. The position A' is shifted from the first, vertical slit 141 toward the second electrode 12*b* by a small distance. As is explained above, it is preferable that the distance between A and A' is within about the width of the first, vertical slit 141 so that the vertical slits 141 and 143 form one enlarged vertical slit.

Thereafter, trimming operations are performed to form slits successively in the same manner as trimming for forming the third, vertical slit 143 and the fourth, horizontal slit 144, until a desired resistance value is obtained. Finally, the substantially the combined slit 14 having a comb shape is obtained.

Example 2

A resistor and a resistor trimming method according to another preferred embodiment of the present invention will be explained with reference to FIG. 2.

Figure 2:
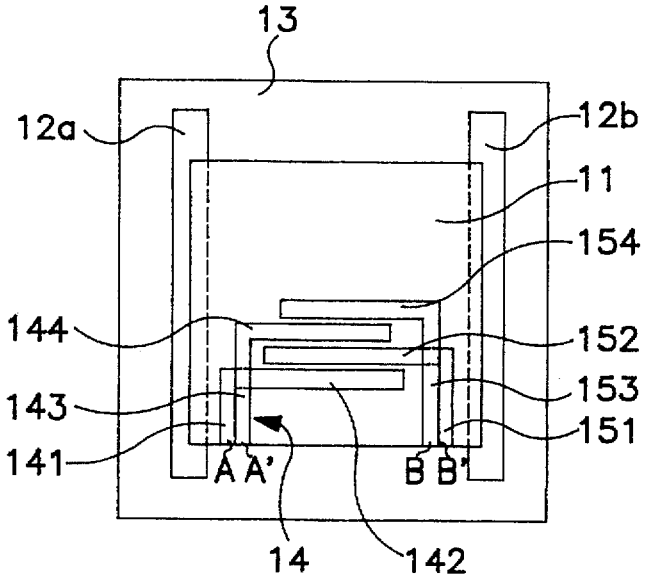
FIG. 2 is a plan view of another trimmed resistor, illustrating another embodiment of the present invention.
Figure 3:
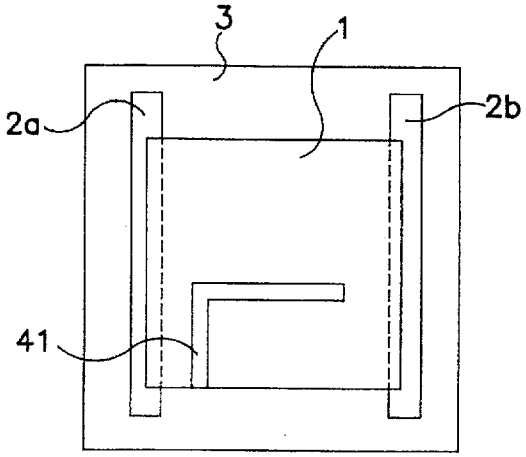
FIG. 3 PRIOR ART
FIG. 3 is a plan view of a trimmed resistor, illustrating an example of prior art.
Figure 4:
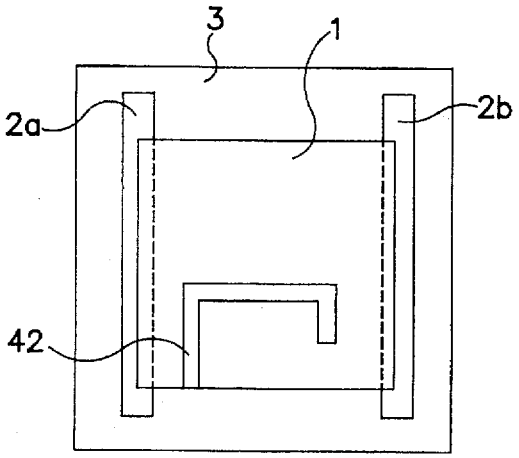
FIG. 4 PRIOR ART
FIG. 4 is a plan view of a trimmed resistor, illustrating another example of prior art.
Figure 5:
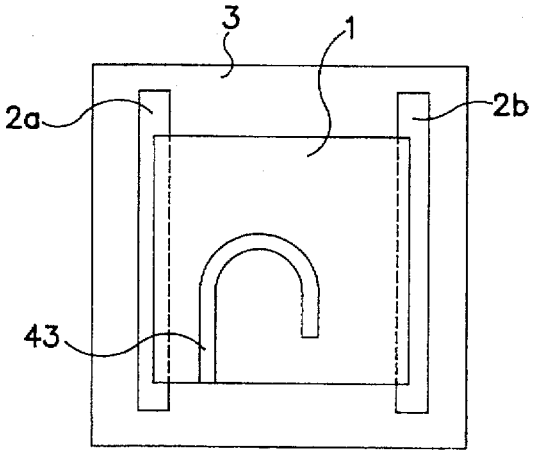
FIG. 5 PRIOR ART
FIG. 5 is a plan view of a trimmed resistor, illustrating still another example of prior art.
Figure 6:
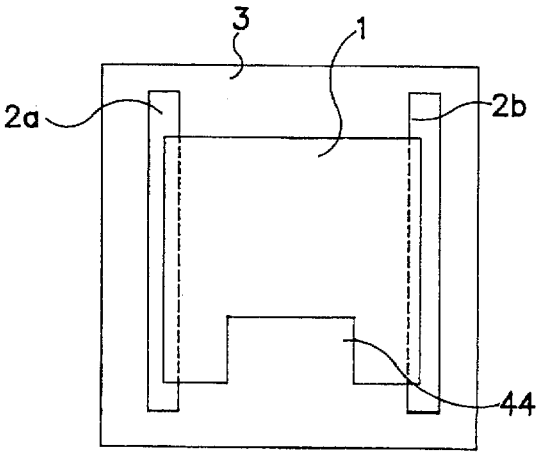
FIG. 6 PRIOR ART
FIG. 6 is a plan view of a trimmed resistor, illustrating still another example of prior art.
Figure 7:
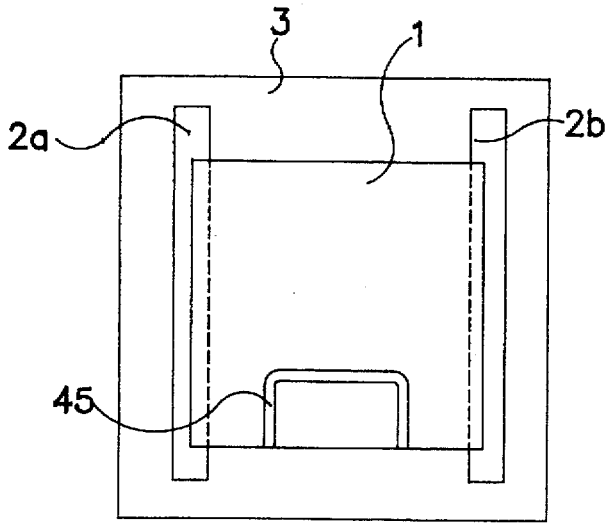
FIG. 7 PRIOR ART
FIG. 7 is a plan view of a trimmed resistor, illustrating still another example of prior art.
Figure 8:
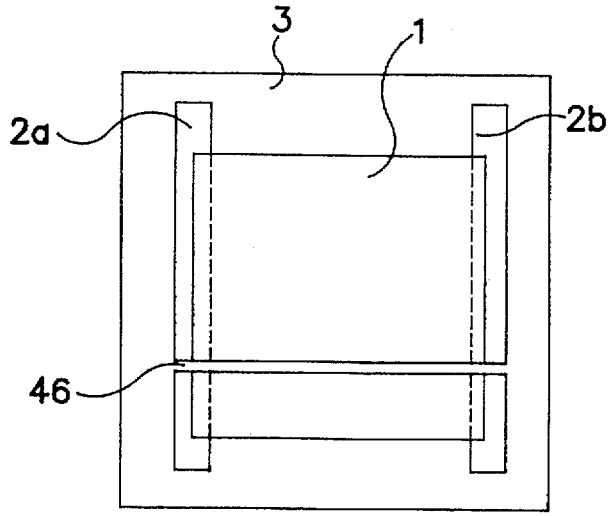
FIG. 8 PRIOR ART
FIG. 8 is a plan view of a trimmed resistor, illustrating still another example of prior art.

As shown in FIG. 2, a resistor is different from the resistor shown in FIG. 1 in that a first combined slit 14 and a second combined slit 15, each having a comb-shape, are provided in the resistor 11 so as to interdigitae or mesh with each other. Note that the first combined slit 14 and the second combined slit 15 include two L-shaped slits, respectively, although the first combined slit 14 shown in FIG. 1 has three L-shaped slits. This is simply for eliminating the complexity of the figure and clarifying the explanation. It is appreciated that the number of the L-shaped slits depends upon the degree of adjusting of resistance.

In the resistor 11, the first combined slit 14 is provided in the same manner as the resistor 11 shown in FIG. 1. The second combined slit 15 includes first L-shaped slit consisting of a first, vertical slit 151 and a second, horizontal slit 152 and a second L-shaped slit consisting of a third, vertical slit 153 and a fourth, horizontal slit 154. The vertical slits 151 and 153 are substantially parallel to the electrodes 12*a* and 12*b*, and the horizontal slits 152 and 154 are substantially perpendicular to the electrodes 12*a* and 12*b*.

The first, vertical slit 151 of the first L-shaped slit is formed in the resistor 11 near to the second electrode 12*b* and extends from one side toward the opposite side of the resistor 11. It is preferable that the start point B of the first, vertical slit 151 as close to the second electrode 12*b* as possible, and is more preferable that the start point B is within about 0.3 mm from the second electrode 12*b*. The second, horizontal slit 152 extends from the end of the first, vertical slit 151 toward the first electrode 12*a*.

The second L-shaped slit of the second combined slit 15 is formed in the resistor 11 in the same manner as the first L-shaped slit, but the start point B' of the third, vertical slit 153 of the second L-shaped slit is shifted toward the first electrode 12*a*, i.e., it is located at a position nearer the first electrode 12*a* than the start point B of the first L-shaped slit. As shown in FIG. 2, it is preferable that the first and third, vertical slits 151 and 153 are adjacent to each other so as to form one enlarged vertical slit. Moreover, the second and fourth, horizontal slits 142 and 144 of the first combined slit 14 and the second and fourth, horizontal slits 152 and 154 of the second combined slit 15 may be adjacent to each other so as to form one enlarged slit. The third, vertical slit 153 is set to be longer than the first, vertical slit 151 in the second combined slit 15. As result, the fourth, horizontal slit 154 is formed in the resistor 11 more towards the opposite edge than the second, horizontal slit 152 in the second combined slit 15.

A resistor trimming method according to Example 2 of the present invention is now described by referring to FIG. 2.

First, the resistor 11 is trimmed from the start point A close to the first electrode 12*a* and parallel to the first electrode 12*a* to form the first, vertical slit 141 of the first combined slit 14. Then, the resistor 11 is trimmed from the end of the first, vertical slit 141 toward the second electrode 12*b* in a perpendicular relation to the first, vertical slit 141 to form a second, horizontal slit 142 in the first combined slit 14.

The resistor 11 is then trimmed from the start point B closer to the second electrode 12*b* and parallel to the second electrode 12*b* to form a third, vertical slit 151. Then, the resistor 11 is trimmed continuously from the third, vertical slit 151 toward the first electrode 12*a* in a perpendicular relation to the third, vertical slit 151, thus forming a fourth, horizontal slit 152.

Then, the resistor is trimmed from the start point A' toward the opposite side of the resistor 11 in parallel to the first electrode 12*a* and then toward to the second electrode 12*b* to form the fifth, vertical slit 143 and the sixth, horizontal slit 144, respectively, in the same way as the formation of the first, vertical slit 141 and the second, horizontal slit 142, respectively. The position A' is shifted from the start point A toward the second electrode 12*b* by a small distance as explained in Example 1. In addition, the fourth, horizontal slit 152 is interposed between the second and sixth, horizontal slits 142 and 144.

Subsequently, the resistor 11 is trimmed from the start point B' toward the opposite side of the resistor 11 in parallel to the second electrode 12*b* and then toward to the first electrode 12*a* to form the seventh, vertical slit 153 and an eighth, horizontal slit 154, respectively, in the same way as the formation of the third, vertical slit 151 and the fourth, horizontal slit 152, respectively. The start point B' is shifted from the start point B toward the first electrode 12*a* by a small distance as explained in Example 1.

Then, additional slits are successively formed by trimming the resistor, until a desired resistance value is obtained. Finally, the L-shaped slit 14 and the L-shaped slit 15 having a comb shape are formed in the resistor 11 so as to interdigitate or mesh with each other.

Figure 9A:
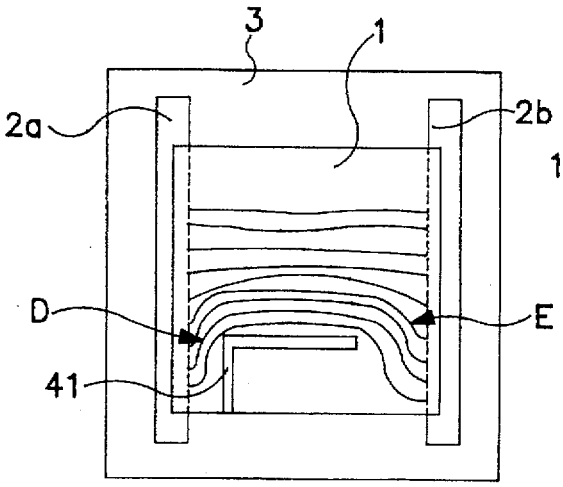
FIG. 9A PRIOR ART
FIG. 9A shows a distribution of a current density in a resistor having a L-shaped according to an example of prior art.
Figure 9B:
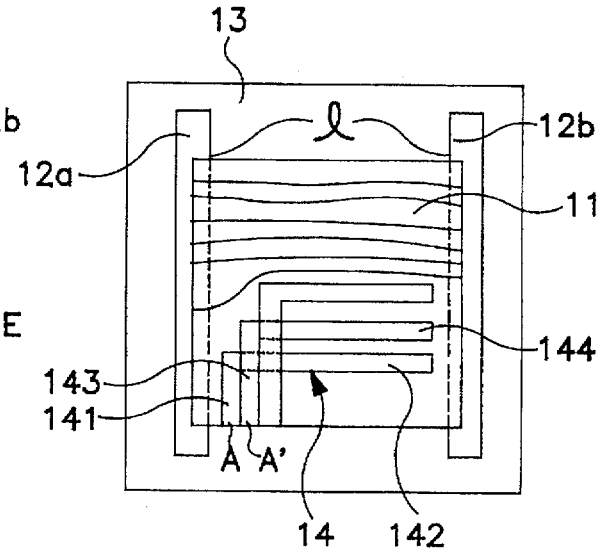
FIG. 9B shows a distribution of a current density in a resistor of the present invention shown in FIG. 1.

Hereinafter, effects of the present invention will be explained. FIG. 9B schematically shows a distribution of a current density in the resistor 11 shown in FIG. 1. As is understood from FIG. 9B, the current density in the resistor 11 distributes uniformly in the resistor 11. This is because the resistor of the invention has at least one L-shape slit which starts from a point close to one of the electrodes 12*a* or 12*b* and has an elongated horizontal slit so as to have about the same length as the distance between the electrodes 12*a* and 12*b*.

Table 1 shows a rate of change of resistance before and after a surge in a lightning surge test. Each of samples used for the test has an area of 50 $mm^2$ and is subjected to ten times of the current flow of 96 A for 8/20 μs. Data shown in Table 1 is the average value obtained from ten samples for Example 1 and Comparative example and from 8 samples for Example 2.

TABLE 1

| | Resistance before surge test (Ω) | | Resistance after surge test (Ω) | | Change rate of resistance (%) | |
|---|---|---|---|---|---|---|
| Sample | Ave. | 3σ | Ave. | 3σ | Ave. | 3σ |
| Example 1 | 49.606 | 0.094 | 49.604 | 0.094 | −0.003 | 0.016 |
| Example 2 | 49.584 | 0.051 | 49.633 | 0.330 | −0.003 | 0.008 |
| Comp. Ex. | 49.538 | 0.133 | 51.197 | 1.277 | 3.350 | 2.602 |

As is apparent from Table 1, a change rate of resistance before and after a surge in a lightning surge test became small, as low as 0.003%, in average. Further, a good surge resistance, which is almost at the same level as the scan-cut prior art embodiment (not shown in Table 1), could be obtained by trimming the slit according to the present invention. Moreover, since a plurality of vertical slits are provided with a shifting starting position in the resistor so as to form one enlarged slit, a slit having a larger width that of single vertical slit is formed in a parallel direction to the electrodes 12*a* and 12*b*. Such an enlarged slit provides the resistor 11 with an improved resistance against a voltage applied across the slit due to a surge, thereby increasing a breakdown voltage applied across the slit due to a surge.

In addition, the present invention provides the resistor trimming method which can be quickly done as compared to the prior art scan-cut and realize steady and reliable trimming as compared to the U-shaped trimming or the lean cut.

As is explained above, it is noted that it is desirable to bring the distance between the first electrode 12*a* and the start point A and the distance between the second electrode 12*b* and the start point B as close to zero as possible in order to provide a good surge resistance to the resistor 11. Further, it is preferable to arrange the horizontal slit extending in one direction so as to extend to a position close the opposite electrode, i.e. so as to have about a same length with a length of the resistor 11.

Figure 10:
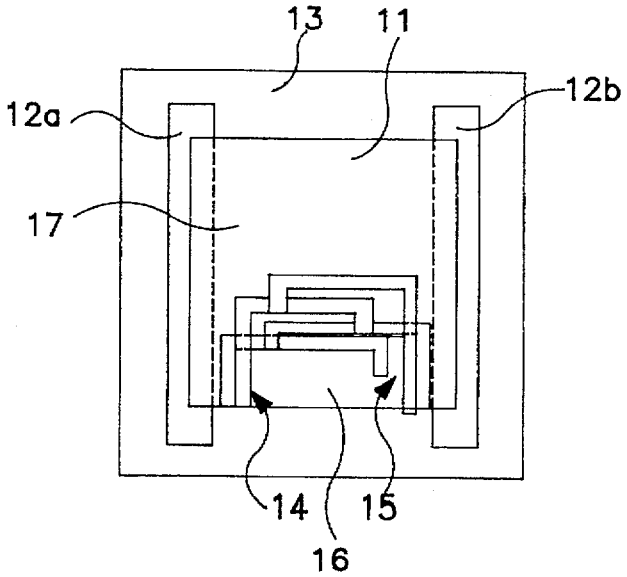
FIG. 10 is a plan view of a trimmed resistor of , illustrating a method of trimming in accordance with the present invention.

Although in the resistors explained in Examples 1 and 2, the slits 14 and 15 includes a plurality of L-shaped slits, the slits 14 and 15 may include a plurality of square U-shaped slits or square bootomed J-shaped slits as shown in FIG. 10. In this case, the slits 14 and 15 may intersect so as to isolate a portion 16 of the resistor from the remaining portion 17 of the resistor 11.

Also, for clarity of explanation, arbitrary reference numbers (e.g., first, second, third . . . ) and terms such as vertical and horizontal have been employed to explain the relationships of the various slits. The use of this terminology in no way restricts the scope of the claims appended hereto.

While preferred embodiments have been described, variations thereto will occur to those skilled in the art within the scope of the present inventive concepts which are delineated by the following claims.

What is claimed is:

1. A resistor trimming method comprising the steps of:

forming a first slit from an edge of a resistor interconnecting a first and second electrodes provided on an insulating substrate in the proximity of and parallel the first electrode;

forming a second slit as a continuation of the first slit toward to the second electrode and perpendicular to the first slit;

forming a third slit from a first point on the edge of the resistor and parallel to the first electrode, the first point being shifted from the first slit toward the second electrode, the third slit having a greater length than the first slit in a direction parallel to the first electrode; and forming a fourth slit as a continuation of the third slit toward the second electrode and perpendicular to the third slit.

2. The resistor trimming method according to claim 1, wherein the first slit and third slit are adjacent to each other and form one combined slit having a width greater than that of the first slit.

3. The resistor trimming method according to claim 1, wherein the first slit is located within about 0.3 mm from the first electrode.

4. The resistor trimming method according to claim 1, wherein the first slit and the second slit constitute a L-shaped slit and the third slit and the fourth slit constitute a L-shaped slit.

5. The resistor trimming method according to claim 1, further comprising the steps of:

forming a fifth slit from a second point on the edge of the resistor and parallel to the first electrode, the second point being shifted from the first point toward the second electrode, the fifth slit having a greater length than the third slit in a direction parallel to the first electrode; and forming a sixth slit as a continuation of the fifth slit toward to the second electrode and perpendicular to the first slit.

6. The resistor trimming method according to claim 1, wherein the first and second slits constitute a square bottomed J-shaped slit.

7. The resistor trimming method according to claim 1, wherein the third and fourth slits constitute a square bottomed J-shaped slit.

8. The resistor trimming method according to claim 1, further comprising the steps of forming a fifth slit as a continuation of the second slit toward the edge of the resistor and perpendicular to the second slit and forming a sixth slit as a continuation of the fourth slit toward the edge of the resistor and perpendicular to the fourth slit.

9. The resistor trimming method according to claim 8, wherein the fifth and sixth slits each form a square square bottomed J-shaped slit.

10. The resistor trimming method according to claim 8, wherein the fifth and sixth slits each form a square bottomed U-shaped slit.

11. The resistor trimming method according to claim 1, wherein the first slit is located within about 0.3 mm from the first electrode.

12. A resistor trimming method comprising the steps of:

forming a first slit from an edge of a resistor interconnecting a first and second electrodes provided on an insulating substrate in the proximity of and parallel to the first electrode;

forming a second slit as a continuation of the first slit toward the second electrode and perpendicular to the first slit;

forming a third slit from the edge of the resistor in the proximity of and parallel to the second electrode, the third slit having a greater length than the first slit in a direction parallel to the first electrode;

forming a fourth slit as a continuation of the third slit toward the first electrode and perpendicular to the third slit;

forming a fifth slit from a first point of the edge of the resistor and parallel to the first electrode, the point being shifted from the first slit toward the second electrode, the fifth slit having a greater length than the fourth slit in a direction parallel to the first electrode; and forming a sixth slit as a continuation of the fifth slit toward the second electrodes and perpendicular to the first slit.

13. The resistor trimming method according to claim 12, wherein the first slit and the fifth slit are adjacent to each other to form one combined slit having a width greater than that of the first slit.

14. The resistor trimming method according to claim 12, wherein the first slit is located within about 0.3 mm from the first electrode.

15. A resistor made from a printed resistance material located between first and second electrodes, wherein first and second L-shaped slits each consisting of a vertical slit and a horizontal slit are provided in the resistor, each of the vertical slits extending from one side of the resistor interconnecting the first and second electrodes toward an opposite side of the resistor in a parallel relation to the first electrode, each of the horizontal slits extending from an end of the corresponding vertical slit toward the second electrode, the vertical slit of the second L-shaped slit is located nearer to the second electrode than that of the first L-shaped slit, and the vertical slit of the second L-shaped slit is longer than that of the first L-shaped slit.

16. The resistor according to claim 15, wherein the vertical slit of the first L-shaped slit is located within about 0.3 mm form the first electrode.

17. The resistor according to claim 15, wherein the vertical slit of the first L-shaped slit and the vertical slit of the second L-shaped slit are adjacent to each other so as to form one combined slit.

18. A resistor made from a printed resistance material located between first and second electrodes, wherein first and second L-shaped slits each consisting of a vertical slit and a horizontal slit are provided in the resistor, each of the vertical slits extending from one side of the resistor interconnecting the first and second electrodes toward an opposite side of the resistor in a parallel relation to the first electrode, one of the horizontal slits extending from an end of the corresponding vertical slit toward the second electrode, another one of the horizontal slits extending from an end of the corresponding vertical slit toward the first electrode, the vertical slit of the first L-shaped slit is located near the first electrode and the vertical slit of the second L-shaped slit is located near the second electrode, and the vertical slit of the second L-shaped slit is longer than that of the first L-shaped slit.

19. The resistor according to claim 18, wherein the vertical slit of the first L-shaped slit is located within about 0.3 mm form the first electrode.

20. The resistor according to claim 18, wherein the vertical slit of the second L-shaped slit is located within about 0.3 mm form the second electrode.

21. The resistor according to claim 18, wherein the horizontal slit of the first L-shaped slit and the horizontal slit of the second L-shaped slit are adjacent to each other so as to form one combined slit.

* * * * *